US006393876B1

(12) United States Patent
Matyko

(10) Patent No.: US 6,393,876 B1
(45) Date of Patent: May 28, 2002

(54) PADLOCK

(75) Inventor: Adalbert Matyko, Ashdod (IL)

(73) Assignee: Mul-T-Lock Technologies Ltd., Yavneh (IL)

( * ) Notice: Subject to any disclaimer, the term of this patent is extended or adjusted under 35 U.S.C. 154(b) by 0 days.

(21) Appl. No.: 09/555,856

(22) PCT Filed: Nov. 16, 1998

(86) PCT No.: PCT/IL98/00557

§ 371 (c)(1),
(2), (4) Date: Sep. 11, 2000

(87) PCT Pub. No.: WO99/29990

PCT Pub. Date: Jun. 17, 1999

(30) Foreign Application Priority Data

Dec. 8, 1997 (IL) ..... 122509

(51) Int. Cl.[7] ..... E05B 67/24

(52) U.S. Cl. ..... 70/38 A; 70/51; 70/52; 70/56

(58) Field of Search ..... 70/38 A, 51, 52, 70/54–56, DIG. 62, 38 R, 38 B, 38 C, 39

(56) References Cited

U.S. PATENT DOCUMENTS

| | | | | | |
|---|---|---|---|---|---|
| 348,864 | A | * | 9/1886 | Richards | 70/39 |
| 385,799 | A | * | 7/1888 | Fraim | 70/38 A |
| 456,744 | A | * | 7/1891 | Sparks | 70/39 |
| 615,206 | A | * | 11/1898 | Babcock | 70/38 C |
| 1,512,589 | A | * | 10/1924 | Freysinger | 70/39 |
| 3,587,261 | A | * | 6/1971 | Berry | 70/38 A X |
| 3,631,896 | A | * | 1/1972 | Meiys | 70/14 X |
| 3,636,738 | A | | 1/1972 | Burakoff et al. | 70/38 A |
| 3,710,603 | A | | 1/1973 | Miller | 70/38 A |
| 3,713,309 | A | | 1/1973 | Miller | 70/38 A |
| 3,783,657 | A | * | 1/1974 | Foote | 70/52 |
| 4,063,435 | A | | 12/1977 | Oilver | 70/38 A |
| 4,104,894 | A | * | 8/1978 | Miller et al. | 70/52 |

(List continued on next page.)

FOREIGN PATENT DOCUMENTS

| | | | | |
|---|---|---|---|---|
| FR | 2671578 A | * | 7/1992 | 70/54 |
| GB | 2169343 A | | 7/1986 | |
| GB | 2 214 557 | | 9/1989 | |
| GB | 2 270 951 | | 3/1994 | |
| HU | 194357 | | 5/1988 | |
| HU | 189780 | | 7/1988 | |

*Primary Examiner*—Lloyd A. Gall
(74) *Attorney, Agent, or Firm*—Nixon & Vanderhye P.C.

(57) ABSTRACT

A lock (10) comprising a lock body (12) defining a top surface (14) and a bottom surface (16), the lock body (12) having a bore (18) formed therein extending from the top surface (14) to a location spaced from the bottom surface (16), a key-operated lock cylinder (20) located in the bore (18) and having a keyway opening (22) facing the bottom surface (16), a key entry aperture (24) being formed in the bottom surface (16) for permitting insertion of a key therethrough into engagement with the keyway opening (22) of the cylinder (20) and being sized so as not to permit the cylinder (20) to pass therethrough, a shackle (26), a locking mechanism located in the lock body (12) and being operated by the lock cylinder (20) for locking the shackle (26), characterized by a multifunctional lock top protector element (60) mounted onto the top surface (14) of the lock body (12), the multifunctional lock top protector element (60) being apertured to accommodate the shackle (26) and to surround at least a portion thereof, the multifunctional lock top protector element (60) overlying the bore (18) so as to prevent access to the cylinder (20) from the top surface (14), the shackle (26) and the multifunctional lock top protector element (60) being configured such that when the shackle (26) is locked by the locking mechanism, the shackle (26) locks the multifunctional lock top protector element (60) in engagement with the top surface (14) of the lock body (12) and in overlying relationship with the bore (18).

7 Claims, 5 Drawing Sheets

U.S. PATENT DOCUMENTS

| | | | | | |
|---|---|---|---|---|---|
| 4,138,868 | A | * | 2/1979 | Richards, Sr. | 70/38 A |
| 4,158,952 | A | | 6/1979 | Oliver et al. | 70/52 |
| 4,180,996 | A | * | 1/1980 | Lebrecht | 70/52 |
| RE30,243 | E | | 4/1980 | Oliver | 70/38 A |
| 4,241,594 | A | | 12/1980 | Miller et al. | 70/38 A |
| 4,763,496 | A | | 8/1988 | Evans et al. | 70/38 A |
| 4,776,187 | A | * | 10/1988 | Evans et al. | 70/38 A |
| 5,174,136 | A | * | 12/1992 | Thwing | 70/38 A |
| 5,186,029 | A | * | 2/1993 | Myers | 70/38 A |
| 5,363,678 | A | * | 11/1994 | Meckbach | 70/38 A |
| 5,377,511 | A | * | 1/1995 | Meckbach | 70/DIG. 62 X |
| 5,572,890 | A | * | 11/1996 | Carpenter | 70/38 A X |
| 5,950,461 | A | * | 9/1999 | Tsai | 70/38 A |

* cited by examiner

FIG. 1
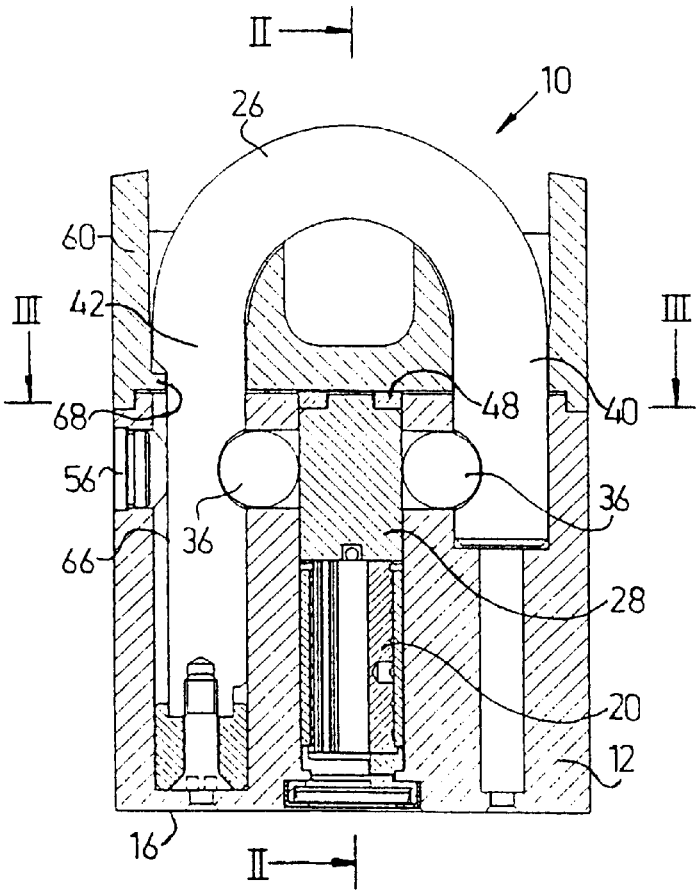
FIG. 2
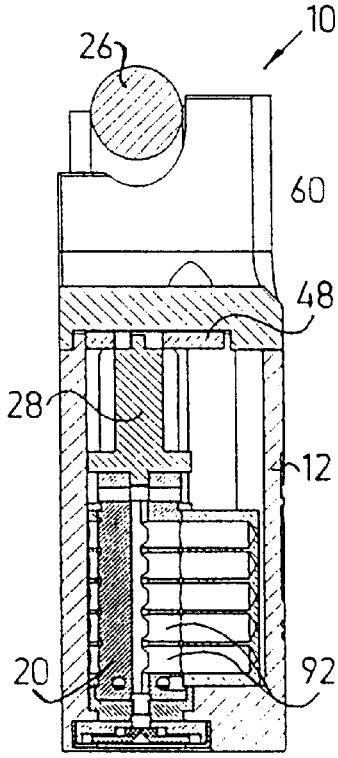
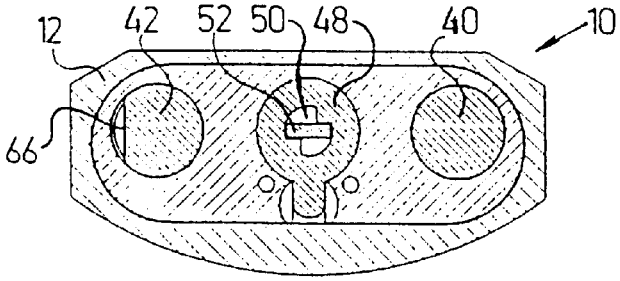
FIG. 3

10
70
26
40
42
38
66
64
60
76
74
62
72
50
48
54
36
53
52
28
30
32
34
90
20
22
24
44
18
14
46
55
56
12
16
88
84
82
86
80

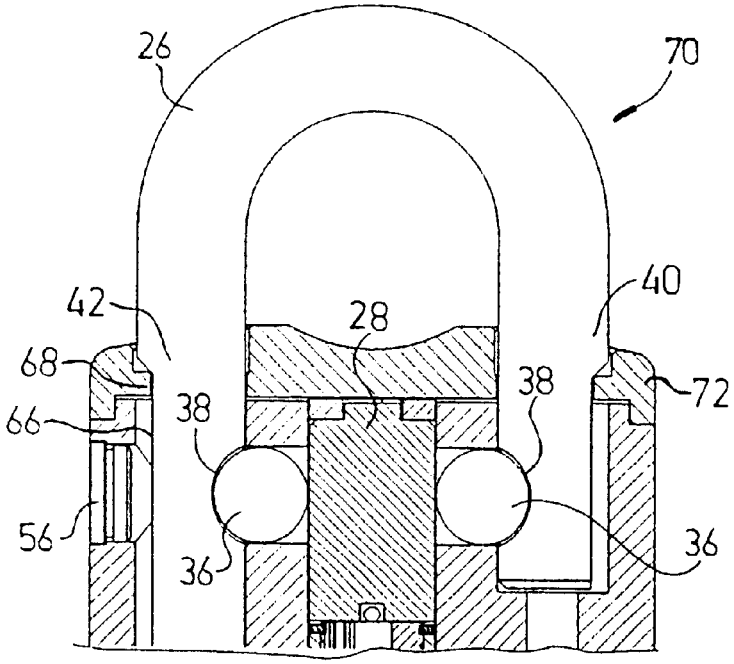
FIG. 6
FIG. 7
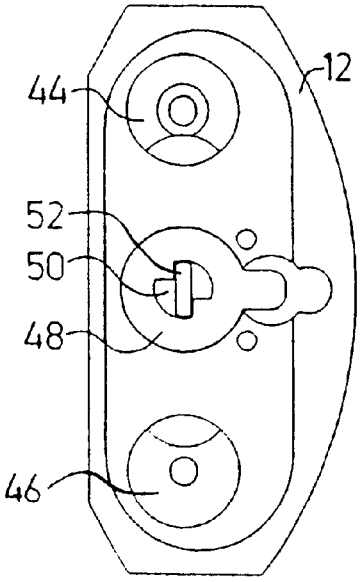
FIG. 8
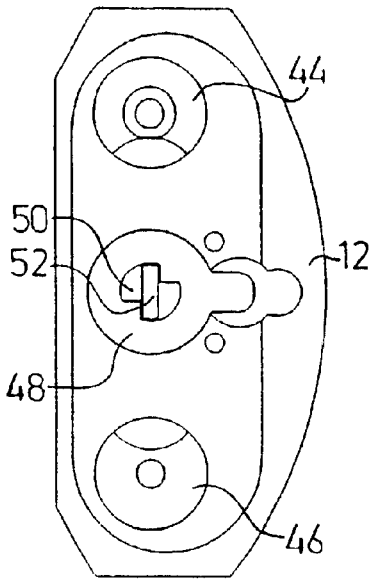

PADLOCK

FIELD OF THE INVENTION

The present invention relates generally to padlocks with a cylinder-guarding closure.

BACKGROUND OF THE INVENTION

It is well known to provide padlocks with high security lock cylinders that are removable through an opening formed in the top surface of the padlock body. For example, U.S. Pat. Nos. 3,713,309 and 4,063,435 both describe arrangements for interchanging the lock cylinder through a top opening in the padlock body.

U.S. Pat. No. 3,636,738 describes a padlock with a cover plate having a very shallow surface hardening.

U.S. Pat. No. 3,710,603 describes a padlock with a sealing cover member that forms an upper closure for a bore for a cylinder.

U.S. Pat. 4,158,952 describes a padlock with a locking plug or cylinder which is removable through a top opening in the lock case. A top closure is provided in the form of a cap which is locked into the padlock case by a loose ball fitting in a groove in the cap and the case.

U.S. Pats. Nos. 3,713,309 and 4,241,594 describe a padlock with a key lock plug removably received in a plug cavity in the casing and an elongated slideway cavity overlying the plug cavity that extends through one end of the padlock casing outwardly adjacent the socket for the shorter leg of the shackle. The slideway cavity receives a reciprocative slidable cover member that covers the plug cavity.

U.S. Pat. Re. 30,243 describes a closure for a padlock body that comprises a circular member having a concave recess in its perimeter coacting with the shorter leg of the padlock shackle at the top of the padlock.

British Patent GB 2169343 describes a high security padlock including a removable lock mechanism within a lock body and a lockable shackle which can form a closed loop with the lock body. The lock mechanism is retained in the lock body by screw threaded means.

SUMMARY OF THE INVENTION

The present invention seeks to provide an improved padlock with a cylinder-guarding closure. The closure is a multifunctional lock top protector element overlying a bore of the cylinder so as to prevent access to the cylinder from the top surface of the padlock. Unlike the prior art, the shackle and the lock top protector element are configured such that when the shackle is locked by a locking mechanism of the padlock, the shackle locks said multifunctional lock top protector element in engagement with said top surface of said lock body and in overlying relationship with said bore.

It is noted that throughout the specification and the claims the term "shackle" is not restricted to a U-shaped shackle with two legs, but rather encompasses any kind of locking element or bolt which extends from a lock body, such as a single locking bolt or latch or any other kind of locking element.

There is thus provided in accordance with a preferred embodiment of the present invention a lock including a lock body defining a top surface and a bottom surface, the lock body having a bore formed therein extending from the top surface to a location spaced from the bottom surface, a key-operated lock cylinder located in the bore and having a keyway opening facing the bottom surface, a key entry aperture being formed in the bottom surface for permitting insertion of a key therethrough into engagement with the keyway opening of the cylinder and being sized so as not to permit the cylinder to pass therethrough, a shackle, a locking mechanism located in the lock body and being operated by the lock cylinder for locking the shackle, a multifunctional lock top protector element mounted onto the top surface of the lock body, the multifunctional lock top protector element being apertured to accommodate the shackle and to surround at least a portion thereof, the multifunctional lock top protector element overlying the bore so as to prevent access to the cylinder from the top surface, the shackle and the multifunctional lock top protector element being configured such that when the shackle is locked by the locking mechanism, the shackle locks the multifunctional lock top protector element in engagement with the top surface of the lock body and in overlying relationship with the bore.

In accordance with a preferred embodiment of the present invention the shackle is formed with at least one undercut which engages a corresponding portion of the multifunctional lock top protector element thereby locking the multifunctional lock top protector element in engagement with the top surface of the lock body and in overlying relationship with the bore.

Further in accordance with a preferred embodiment of the present invention the shackle includes a yoke having a pair of locking legs which are lockingly engaged by the locking mechanism.

Still further in accordance with a preferred embodiment of the present invention the lock also includes a key aperture cover assembly mounted on the bottom surface of the lock body.

Additionally in accordance with a preferred embodiment of the present invention the cylinder is formed with an apertured housing, pins and a plug which are configured such that the pins may be removed from the apertured housing via the apertures without removing the plug from the housing, when the plug is in a predetermined rotational orientation relative to the apertured housing.

In accordance with a preferred embodiment of the present invention the lock also includes a rotation restricting element that restricts rotation of the key-operated lock cylinder within a predetermined angular range, the rotation restricting element being selectively arrangeable with respect to the key-operated lock cylinder in two orientations, wherein in a first orientation the rotation restricting element permits rotation of the key-operated lock cylinder in a clockwise direction to open the lock and wherein in a second orientation the rotation restricting element permits rotation of the key-operated lock cylinder in a counterclockwise direction to open the lock.

Further in accordance with a preferred embodiment of the present invention the shackle is completely removable from the lock body.

BRIEF DESCRIPTION OF THE DRAWINGS

The present invention will be understood and appreciated more fully from the following detailed description, taken in conjunction with the drawings in which:

FIGS. 1–3 simplified sectional illustrations of a padlock constructed and operative in accordance a preferred embodiment of the present invention;

FIG. 6 is a simplified sectional illustration of the padlock of FIG. 5;

FIGS. 7 and 8 are simplified pictorial illustrations of a rotation restricting element constructed and operative in accordance with a preferred embodiment of the present invention, arranged in two different orientations with respect to a key-operated lock cylinder of the padlock of either FIGS. 1–4 or of FIGS. 5 and 6;

DETAILED DESCRIPTION OF A PREFERRED EMBODIMENT

Figures 4, 5:
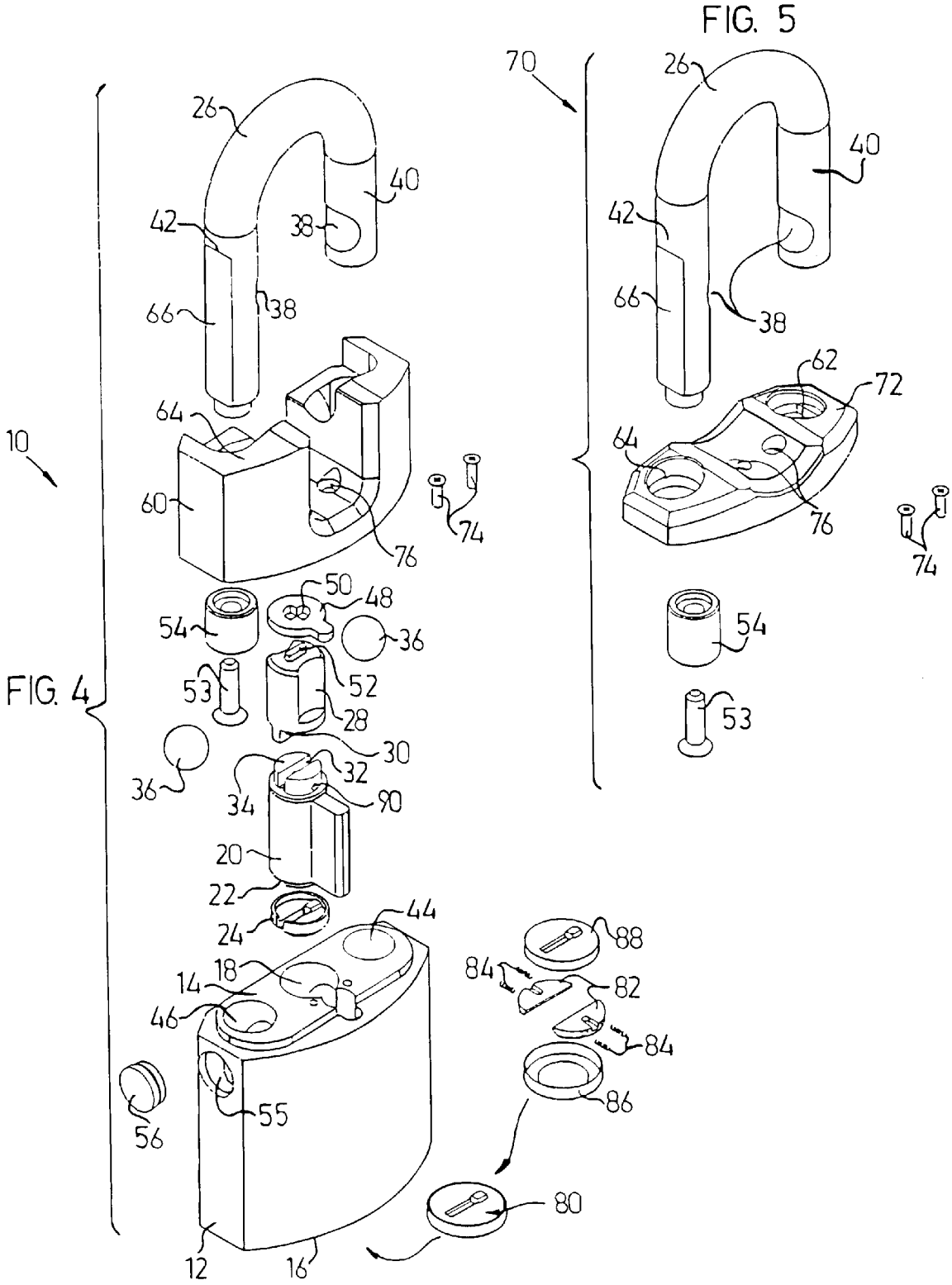
FIG. 4 is a simplified exploded pictorial illustration of the padlock of FIGS. 1–3.
FIG. 5 is a simplified exploded pictorial illustration of a padlock constructed and operative in accordance with another preferred embodiment of the present invention.

Reference is now made to FIGS. 1–4 which illustrate a padlock 10 constructed and operative in accordance with a preferred embodiment of the present invention.

Padlock 10 includes a lock body 12 defining a top surface 14 and a bottom surface 16. A bore 18 is formed in lock body 12 extending from top surface 14 to a location spaced from bottom surface 16.

A key-operated lock cylinder 20 is located in bore 18 and has a keyway opening 22 (seen in FIGS. 4 and 9) facing bottom surface 16. A key entry aperture 24 (shown in FIGS. 4 and 9) is formed in bottom surface 16 for permitting insertion of a key (not shown) therethrough into engagement with keyway opening 22. Key entry aperture 24 is sized so as not to permit cylinder 20 to pass therethrough.

A locking mechanism is located in lock body 12 and is operated by lock cylinder 20 to lock a shackle 26. In FIGS. 1–4, shackle 26 comprises a yoke having a pair of locking legs. The locking mechanism preferably comprises an actuator pin 28 which includes a protruding portion 30 which cooperates with a recess 32 formed at an end of a plug 34 in cylinder 20. Rotation of plug 34 thus causes rotation of actuator pin 28 via the mating of protruding potion 30 in recess 32. Actuator pin 28 selectively urges a pair of balls 36 against a corresponding pair of grooves 38 formed in a shorter leg 40 and a longer leg 42 of shackle 26. Legs 40 and 42 are received in bores 44 and 46, respectively, formed in lock body 12. As is well known in the art, when balls 36 are urged outwardly against grooves 38, shackle 26 is in locked engagement with lock body 12.

Rotation of actuator pin 28 is preferably restricted within a predetermined angular range by means of a rotation restricting element 48. Referring additionally to FIGS. 7 and 8, it is seen that rotation restricting element 48 is formed with an aperture 50 which somewhat resembles a figure eight. Aperture 50 receives therein an actuating member 52 extending from actuator pin 28. Rotation restricting element 48 is selectively arrangeable with respect to cylinder 20 in two orientations. FIG. 7 illustrates a first orientation wherein a key can turn actuating member 52 in a counterclockwise direction only (when viewed from below, i.e., member 52 can only be rotated in a clockwise direction when viewed from the top, which is the view illustrated in FIG. 7) to open lock 10.

Alternatively, rotation restricting element 48 can be flipped over to the orientation shown in FIG. 8. FIG. 8 illustrates a second orientation wherein a key can turn actuating member 52 in a clockwise direction only (when viewed from below, i.e., member 52 can only be rotated in a counterclockwise direction when viewed from the top, which is the view illustrated in FIG. 8) to open lock 10.

Leg 42 of shackle 26 is preferably pinned inside lock body 12 to a pin 53 which passes through a bushing 54. An assembly access hole 55 pluggable by a plug 56 may be formed in lock body 12 to aid in reaching inner elements of the lock 10 during assembly or repair of the lock.

A multifunctional lock top protector element 60 is mounted onto top surface 14 of lock body 12. Protector element 60 has a pair of apertures 62 and 64 formed therein to accommodate legs 40 and 42, respectively, of shackle 26. Protector element 60 surrounds at least a portion of shackle 26 to provide excellent protection against tampering thereof Protector element 60 overlies bore 18 so as to prevent access to cylinder 20 from top surface 14.

It is a particular feature of the present invention that shackle 26 and protector element 60 are configured such that when shackle 26 is locked by the locking mechanism, shackle 26 locks protector element 60 in engagement with top surface 14 and in overlying relationship with bore 18. Preferably shackle 26 is formed with at least one undercut 66 which engages a corresponding portion 68 (seen in FIG. 1) of protector element 60, thereby locking protector element 60 in engagement with top surface 14 and in overlying relationship with bore 18, i.e., protector element 60 cannot be lifted off top surface 14.

Reference is now made to FIGS. 5 and 6 which a padlock 70 constructed and operative in accordance with another preferred embodiment of the present invention. Padlock 70 is preferably identical to padlock 10 with like numerals designating like elements. Padlock 70 differs from padlock 10 only in that padlock 70 is equipped with a multifunctional lock top protector element 72 which surrounds less of a portion of shackle 26 than protector element 60. Protector element 72 is preferred for applications requiring locking chains and the like which can not be easily accessed with the more enveloping protector element 60. Protector elements 60 and 72 may be fastened to lock body 12 by means of screws 74 through mounting holes 76.

Figure 9:
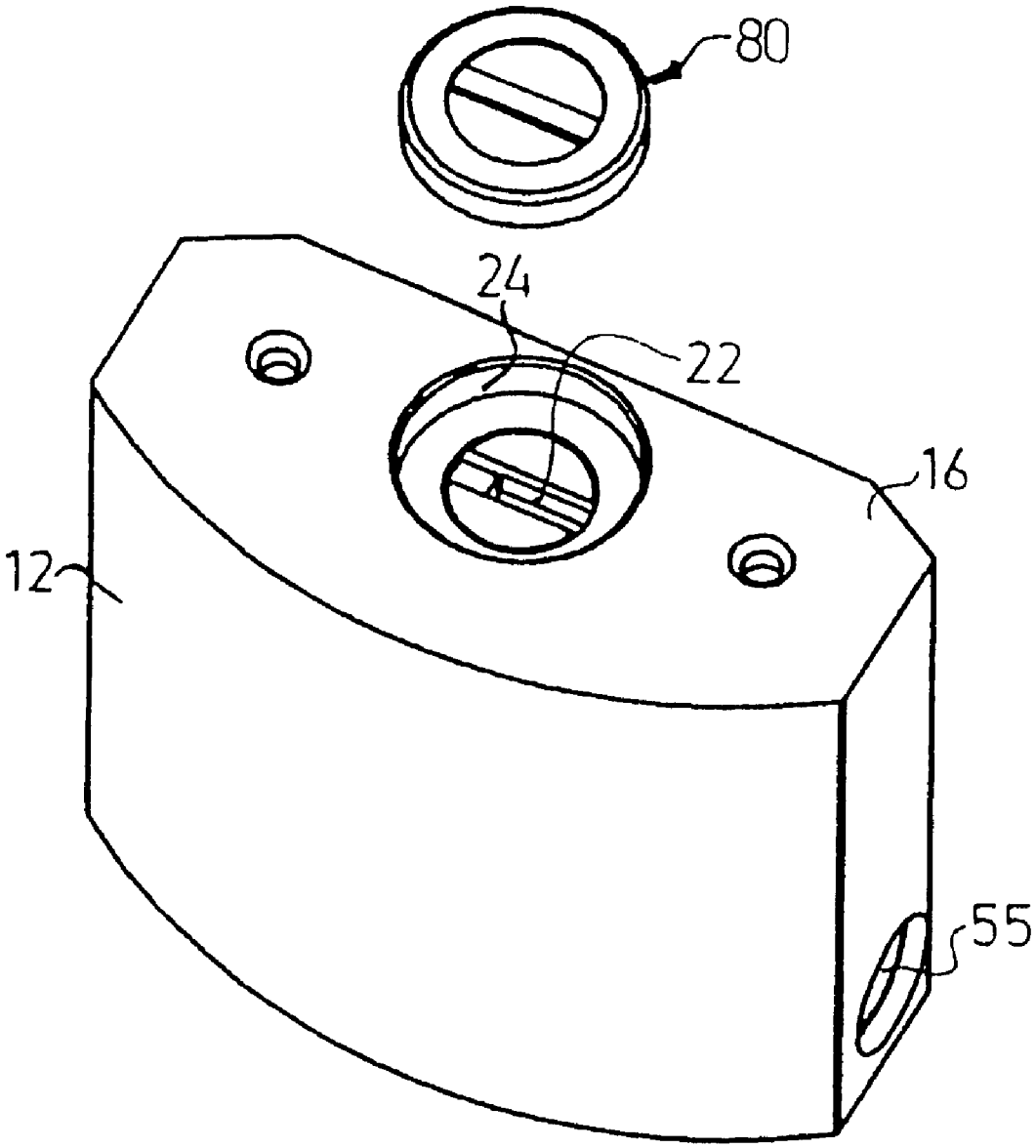
FIG. 9 is a simplified exploded pictorial illustration of a key aperture cover assembly mounted on the bottom surface of the lock body of FIGS. 1–4 or of FIGS. 5 and 6, constructed and operative in accordance with a preferred embodiment of the present invention, FIG. 9 showing the lock body in an inverted position relative to the positions shown in FIGS. 1–8.

Reference is now made to FIGS. 4 and 9. In accordance with a preferred embodiment of the present invention, lock 10 or lock 70 includes a key aperture cover assembly 80 mounted on bottom surface 16 of lock body 12. Assembly 80 preferably includes a pair of shutters 82 biased by a biasing device, such as a plurality of springs 84. Shutters 82 and springs 84 are preferably housed in a housing 86 covered by a dust cover 88. Shutters 82 turn together with the turning of the key.

Lock cylinder 20 is preferably constructed such that when cylinder 20 is removed from lock body 12, pins can be rapidly and easily replaced and interchanged. Preferably cylinder 20 includes a housing formed with apertures 90 (one of which is shown in FIG. 4) such that a plurality of pins 92 in plug 34 may be removed from the apertured housing via apertures 90 without removing plug 34 from the housing, when plug 34 is in a predetermined rotational orientation relative to the apertured housing.

Figure 10:
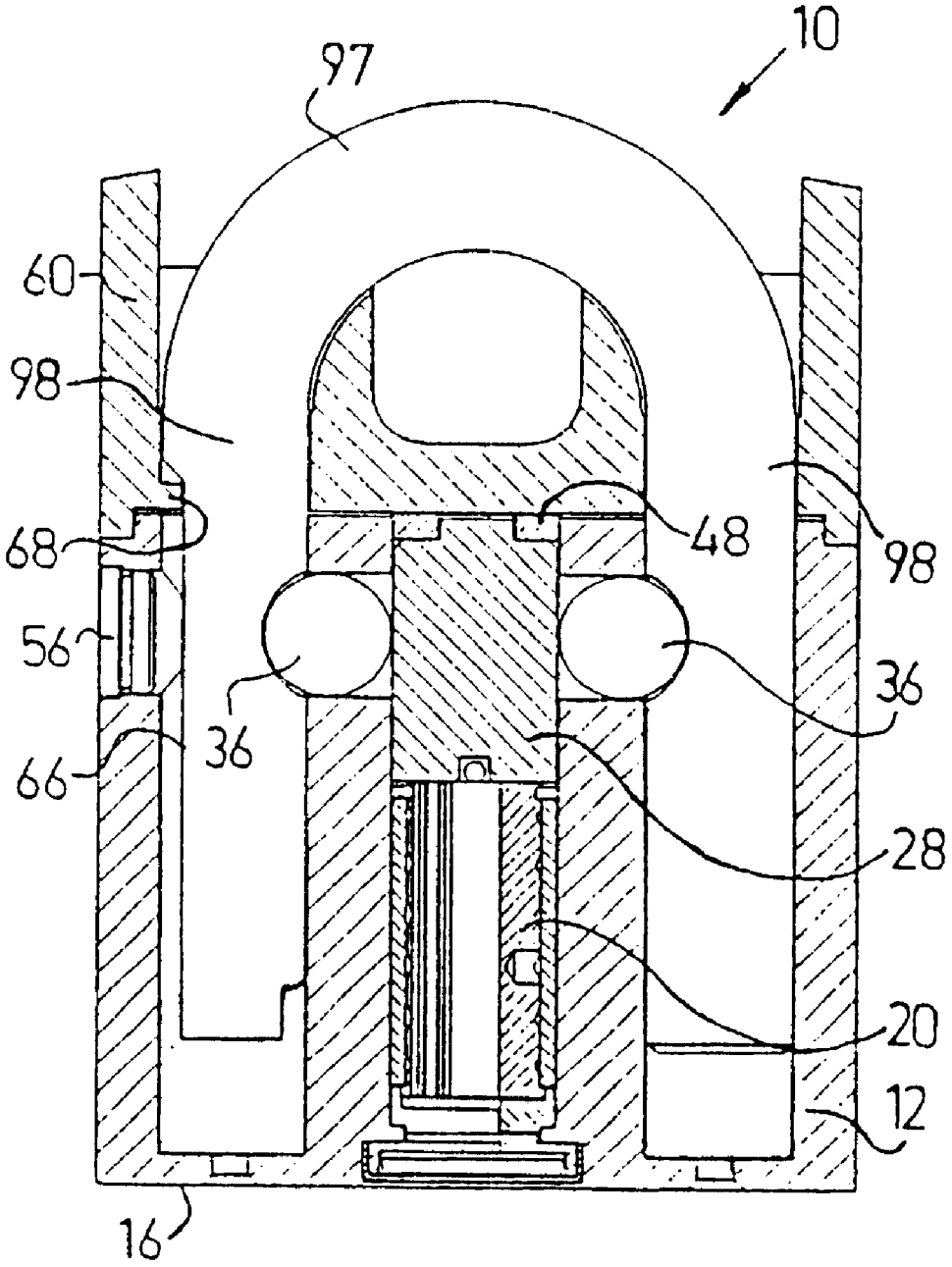
FIG. 10 is a simplified sectional illustration of a padlock constructed and operative in accordance with another preferred embodiment of the present invention, having a removable shackle.

Reference is now made to FIG. 10 which illustrates that padlock 10 may be constructed, in accordance with another preferred embodiment of the present invention, with a removable shackle 97. Shackle 97 has two locking legs 98 of generally equal length and neither leg is pinned inside lock body 12 so that shackle 97 can be completely removed from lock body 12.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A lock (10) comprising:

a lock body (12) defining a top surface (14) and a bottom surface (16), the lock body (12) having a bore (18) formed therein extending from the top surface (14) to a location spaced from the bottom surface (16);

a key-operated lock cylinder (20) located in the bore (18) and having a keyway opening (22) facing the bottom surface (16), a key entry aperture (24) being formed in the bottom surface (16) for permitting insertion of a key therethrough into engagement with the keyway opening (22) of the cylinder (20) and being sized so as not to permit the cylinder (20) to pass therethrough;

a shackle (26) having at least two legs;

a locking mechanism located in said lock body (12) and being operated by said lock cylinder (20) for locking at least two of said at least two legs of said shackle (26);

characterized by a multifunctional lock top protector element (60) mounted onto the top surface (14) of said lock body (12), said multifunctional lock top protector element (60) being apertured to accommodate at least two of said at least two legs of said shackle (26) and to surround at least a portion of each leg which said multifunctional lock top protector element (60) is apertured to accommodate, said multifunctional lock top protector element (60) overlying said bore (18) so as to prevent access to said cylinder (20) from said top surface (14), said shackle (26) and said multifunctional lock top protector element (60) being configured such that when said shackle (26) is locked by said locking mechanism, said shackle (26) locks said multifunctional lock top protector element (60) in engagement with said top surface (14) of said lock body (12) and in overlying relationship with said bore (18), and further characterized in that said shackle (26) is formed with at least one undercut (66) on each of said legs that said multifunctional lock top protector element (60) is apertured to accommodate, wherein each undercut engages a corresponding portion of said multifunctional lock top protector element (60) thereby locking said multifunctional lock top protector element (60) in engagement with said top surface (14) of said lock body (12) and in overlying relationship with said bore (18).

2. A lock (10) according to claim 1 wherein said shackle (26) comprises a yoke having a pair of locking legs (40, 42) which are lockingly engaged by said locking mechanism.

3. A lock (10) according to claim 1 wherein said multifunctional lock top protector element is formed with a mating portion which is in mating engagement with a portion of said shackle intermediate said at least two legs of said shackle when said shackle is lockingly engaged by said locking mechanism.

4. A lock (10) according to claim 1 further compromising a key aperture cover assembly (80) mounted on the bottom surface (16) of the lock body (12).

5. A lock (10) according to claim 1 wherein said cylinder (20) is formed with an apertured housing formed with apertures (90), pins (92) and a plug (34) which are configured such that the pins (92) may be removed from the apertured housing via the apertures (90) without removing the plug (34) from the housing when the plug (34) is in a predetermined rotational orientation relative to the apertured housing.

6. A lock (10) according to claim 1 further comprising a rotation restricting element (48) that restricts rotation of said key-operated lock cylinder (20) within a predetermined angular range, said rotation restricting element (48) being selectively arrangeable with respect to said key-operated lock cylinder (20) in two orientations, wherein in a first orientation said rotation restricting element (48) permits rotation of said key-operated lock cylinder (20) in a clockwise direction to open said lock (10) and wherein in a second orientation said rotation restricting element (48) permits rotation of said key-operated lock cylinder (20) in a counterclockwise direction to open said lock (10).

7. A lock (10) according to claim 1 wherein said shackle (26) is completely removable from the lock body (12).

* * * * *